United States Patent [19]

Stone

[11] 4,256,226

[45] Mar. 17, 1981

[54] BOTTLE CONTAINER AND METHOD OF ERECTING AND LOADING THE SAME

[75] Inventor: Orison W. Stone, New Haven, Vt.

[73] Assignee: Pack Image, Inc., Middlebury, Vt.

[21] Appl. No.: 58,850

[22] Filed: Jul. 19, 1979

[51] Int. Cl.[3] ..... B65D 5/44; B65D 5/46; B65D 5/54

[52] U.S. Cl. ..... 206/427; 206/140; 206/162; 206/614; 229/52 BC

[58] Field of Search ..... 206/427, 140, 141, 162, 206/614, 158; 229/52 B

[56] References Cited

U.S. PATENT DOCUMENTS

| | | | |
|---|---|---|---|
| Re. 29,063 | 12/1976 | Craser | 206/162 |
| 2,760,677 | 8/1956 | Ariveson | 206/140 |
| 3,078,032 | 2/1963 | Robinson et al. | 229/52 B |
| 3,098,583 | 7/1963 | Sherman et al. | 206/140 |
| 3,176,902 | 4/1965 | Champlin | 206/140 |
| 3,186,545 | 6/1965 | Conrades | 206/140 |
| 3,974,911 | 8/1976 | Graser | 206/141 |
| 4,131,230 | 12/1978 | Koehlinger et al. | 206/158 |

*Primary Examiner*—William T. Dixson, Jr.
*Attorney, Agent, or Firm*—Wood, Herron & Evans

[57] ABSTRACT

A returnable container for bottles wherein the bottles are substantially completely enclosed in the container. The container is adapted to be opened to remove the bottles while retaining sufficient structural integrity to form a container for the return of the bottles. The container is formed as a tube having a bottom wall, two end walls, a top wall with side walls enclosing the bottles within the tube. An internal brace consisting of a cross panel glued to the top wall and depending centrally located panels provide an inverted channel-shaped beam which braces the container against collapse even after the side walls have been substantially completely destroyed to open the container.

11 Claims, 9 Drawing Figures

BOTTLE CONTAINER AND METHOD OF ERECTING AND LOADING THE SAME

This invention relates to a container for bottles, and more particularly, to a container which substantially completely encloses the bottles.

In U.S. Pat. No. 3,090,520, there is disclosed a container for six bottles. The container consists of a tube formed by a bottom wall, a top wall and two end walls. Bottles are side loaded into the tube, and then upper and lower side flaps are brought around the bottles to completely enclose the bottles except for the bottle crowns and caps which projects throughout apertures in the top wall.

This type of container has been in use for many years and is particularly useful in packaging a beverage which should not be exposed to light over a very long period as, for example, beer which is contained in clear bottles.

Access to the bottles is usually attained by pulling up on the upper side flap. In the normal course of opening the container, the structural integrity of the container is destroyed. The container thus is not really useful as a container for returnable bottles.

Over the past few years, for ecological reasons, there has been a greater emphasis on returning bottles after they have been emptied of their contents. A number of states have even passed laws preventing the sale of beverages in non-returnable or one-way bottles. To the extent that returnable bottles are sold in the container described above, the container presents a problem. Since removal of the bottles from the container, for all practical purposes, requires the destruction of the container, the bottles must be returned in another type of container as, for example, a paper bag. The consumer, who is used to carrying his returnable bottles in the basket-type container in which they are usually sold, may be reluctant to buy a product in a container which is not useful as other products having returnable containers.

It has therefore been an objective of the present invention to improve the container described above so that it can be opened to remove the bottles while still retaining sufficient structural integrity to enable the container to be used for carrying returns.

This objective of the invention has been attained by providing a central brace secured to the top wall of the container and extending into the container between the two rows of bottles on either side of the container. The central brace actually forms an inverted channel-shaped beam which imparts sufficient structural integrity to the container that it can be used even after it has been opened. If there were no central brace, and if the side walls were removed as they usually are in opening a container, the remaining structure would be simply a very flexible, flimsy tube which cannot carry a load of six bottles. That same tube, however, having a channel-shaped brace extending across the top and engaging the end walls is substantially rigidified and is not only suitable for carrying six empty returns but is also suitable for carrying six full bottles. Thus, it is handy, for example, for the host who opens his container and carries it around the room passing out bottles to his guests. Further, the brace is applied to the known container structure in such a way as to permit the container to be erected and filled on a machine of the type which is used to erect and fill the prior containers of U.S. Pat. No. 3,090,520 with only minor modification to the machine. See U.S. Pat. No. 3,225,510 for such a machine.

Still further, the blank provides extra billboard space for printing the bottler's advertising.

The depending panels of the brace may extend all the way to the bottom wall, in which event they perform a dual function of providing complete separation between the bottles on both sides of the container. The braces may extend about two-thirds of the way down to the bottom of the container. In that event, it is advisable to scallop the edges of the panels so that they do not scrape the labels off the bottles. Finally, the depending panels of the brace could terminate above the bottle labels and still provide a satisfactory bracing function but without contacting bottle labels during loading of bottles into the container.

Another objective of the invention has been to provide a method of forming and filling the container. At the converter, a single blank of five panels is formed. Four of the panels are very similar to the four panels of the prior container of the '520 patent. The fifth panel is the brace and is hinged at the end of the first four panels opposite to the end where the top panel is positioned. It has an alignment tab on it which cooperates with a slot between the juncture of the top panel and the end panel. In the manufacture at the converters, the brace panel and an end panel are folded over the end panel and the bottom panel, respectively. Glue is applied and the top panel is swung over onto the brace panel and glued to it at the central portion. In the folding, the tab projects through the slot and thus provides assurance of precise alignment of the top panel and the brace panel.

At the bottlers, the containers are run on a machine substantially the same as that of U.S. Pat. No. 3,225,510. An additional plow must be provided to push the brace tab at a downward angle. Thereafter, the introduction of the bottles, generally in known manner, into the container forces the brace inwardly to its vertical position.

The several objectives and features of the invention will become more readily apparent from the following detailed description taken in conjunction with the drawings in which.

Figure 1:
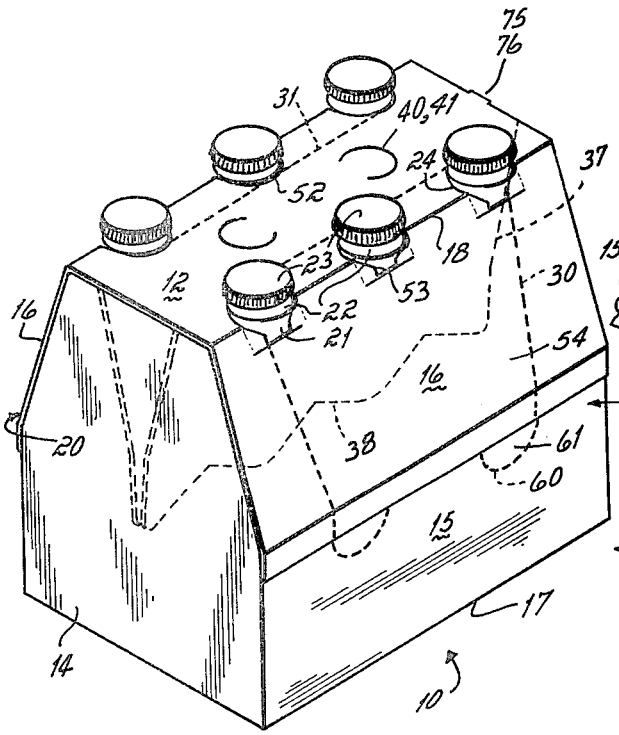
FIG. 1 is a perspective view of the container with bottles inserted.
Figure 2:
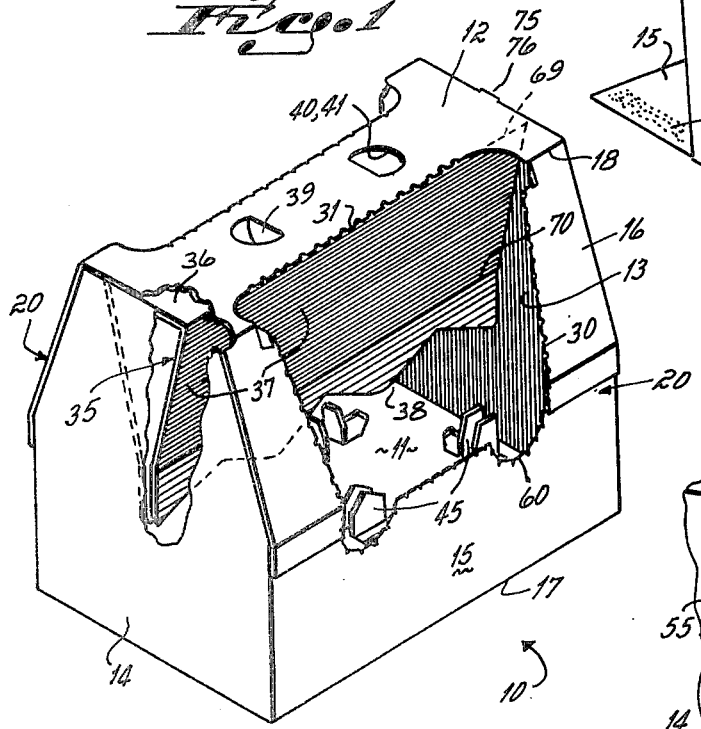
FIG. 2 is a perspective view of the container with the sides opened up and the bottles removed.

Referring to FIGS. 1 and 2, the container of the present invention is shown at 10 and consists of a tube formed by a bottom wall 11, a top wall 12 and first and second end walls 13 and 14. A lower side flap 15 is hinged to each side of the bottom wall along a hinge line 17 and an upper side flap 16 is hinged to each side of the top wall along a hinge line 18. The flaps 15 and 16 form a side wall 20 when the container is filled and closed. The container receives bottles as, for example, beer bottles 21 which are substantially completely enclosed by the container except for the crowns 22 and caps 23 which project above the top wall through apertures 24. The apertures 24 are formed at the juncture of the top wall 12 and upper side flaps 16 as defined by the hinge line 18.

The upper side flap 16 is perforated along two generally vertical lines 30 running up the side flap and along a horizontal line 31 running along the top wall between the endmost apertures. The container can be opened by removing the perforated panel, as shown in FIG. 2, so that the bottles contained within can be removed.

A brace panel 35 is glued to the top wall 12. The brace panel 35 has a cross panel 36 and two depending panels 37 which together form an inverted channel-shaped beam which strengthens and rigidifies the container. The lower edges of the depending panels 37 are scalloped as at 38 so as to minimize the abrasion on the labels on the bottles when they are loaded into the container as would occur if the depending panels were straight edges.

Aligned finger holes 40, 41 are provided in the top wall 12 and brace panel 35, respectively. The finger holes have inwardly-projecting tabs 29 which are cut out of both the top wall and the panel and are pushed inwardly by the customer. The double thickness finger holes are more comfortable to the fingers of the customer as he carries his package of six full bottles than are a single thickness finger holes.

The bottom wall 11 has upwardly-projecting tabs 45 which provide a double thickness separation between adjacent bottles of at least 0.040 inch thickness of material as required by I.C.C. regulations. The tabs form no part of the present invention and are disclosed in the '520 patent.

The container of the present invention is preferably formed from a one-piece blank 50 as shown in FIGS. 6–9. The blank 50 is somewhat similar to the four-panel blank of the '520 patent in that it has top, bottom and end panels. However, the panels are rearranged slightly and the brace panel 35 is added as a new element. More particularly, having reference to FIG. 6, the blank has, in serial fashion, a top panel 51 which forms the top wall 12 and the upper side flaps 16; the first end panel 13; the bottom panel 11 which carries lower side flaps 15; the second end panel 14; and the brace panel 35.

The top panel 51 contains the vertical perforations 30 and the horizontal perforations 31 passing through apertures 24 to create a removable panel by which access may be had to the container to remove the bottles. The apertures 24 are formed along the juncture 18 between the side flaps 16 and the panel 12. This particular location of the apertures permits the upper side flaps to be swung upwardly while bottles are side-loaded into the container, the bottles engaging the edge 52 of the aperture 24 which lies in the top panel. After the bottles are properly inserted, the side flaps are plowed down over the bottle cap and crown with that portion of the aperture indicated at 53 engaging the necks of the bottles to confine the bottles within the container and to space them apart so as to avoid contact with each other.

Each end panel 13 and 14 has upper flaps 55 which will underlie the upper side flaps 16 when they are plowed down to enclose the bottles. The end panels 13 and 14 also contain glue flaps 56 to which the lower side panels 15 are glued after the bottles are inserted in the container.

The bottom panel 11 has divider tabs 45 partially cut out of the bottom panel. These tabs are projected upwardly into the container so as to provide double thickness dividers between the bottoms of adjacent bottles.

The lower side flaps 15 optionally may be perforated along their edges as at 60 to present lift tabs 61. The outer edge of the flaps 15 have two outboard glue areas 62 and a center glue area 63 by which the lower flap 15 will be glued to the lower edge of the upper flap 16 and a glue area 83 which will be glued to the flaps 56. As will be seen when the container is erected, the lift tabs 61 can be used to permit the user to punch through the side wall of the container (FIGS. 1 and 2) and lift up on the upper flap so as to tear away the central access panel 54. Alternatively, if the glue bond at the central area 63 is not too strong, the user can simply lift at the center of the lower edge of flap 16 and pull up to open the container. Or, he can pull from the top horizontal line 31 down the container to open it up.

The brace panel 35 is hinged to the second end panel 14 along a hinge line 65. Two finger holes 41 are partially cut through the cross panel 36. These finger holes will align with similar finger holes 40 partially cut out of the top wall 12. The cross panel has two outboard and a central glue area 68 by which the cross panel is secured to the underside of the top wall 12, as will appear below. The cross panel has hinge lines 69 by which the depending panels 37 are attached to the cross panel. The free edges of the depending panels 37 are scalloped, as indicated at 38, and are scored as at 70 so that when swung together during loading, the lower ends can flex along the score lines 70 as shown in FIG. 2.

The transverse dimension indicated at a (FIG. 6) of the cross panel 36 should be less than the transverse distance b between the apertures 24 in the top wall so that when the cross panel is glued to the top wall, there will be no blocking or interference with the apertures.

The cross panel 36 has an alignment tab 75 projecting from the central portion of its free edge. A corresponding alignment slot 76 is formed between the juncture of the top panel 51 and the first end panel 13 which will receive the tab 75 during the process of forming the folded container blank at the converters.

The end wall 14 is connected to the bottom panel 11 on a hinge line 77 which is slightly skewed from the hinge line 78 between the bottom panel 11 and the end wall 13. The slight skewing will cause the tab 75 to be slightly misaligned with the slot 76 after the first fold is made for reasons as will appear below.

Figure 8:
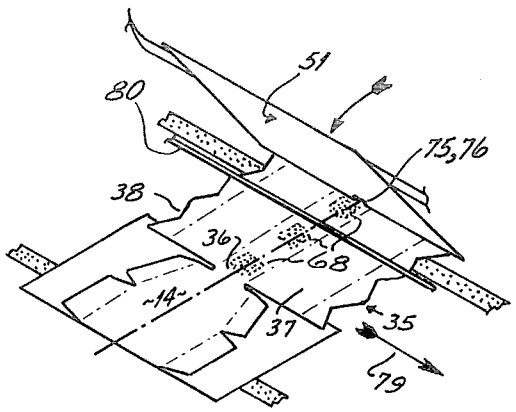
FIGS. 7, 8 and 9 are views of a series of steps of folding the blank by the converter, to the flat folded and glued condition ready for erecting and loading.
Figure 7:
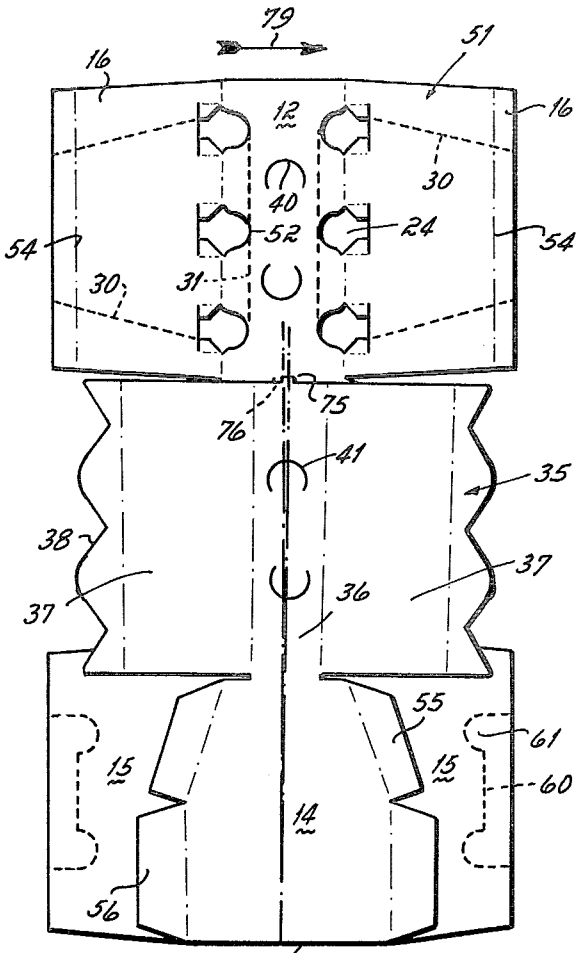

In the folding of the blank, it should be assumed that the blank is moving in the direction of the arrow 79. While moving in that direction, a first fold is made along the hinge line 77 and brings the blank into the configuration shown in FIG. 7 with the brace panel 35 and the second end panel 14 overlying the first end panel 13 and the bottom panel 11, respectively. As can be seen in FIG. 7, the tab 75 is slightly misaligned with respect to the slot 76. As the blank continues to move in the direction of the arrow, the panel 51 is first folded to the angle (about 45°) as shown in FIG. 8 to open up the slot 76. Thereafter, the brace panel 35 passes under a gluer drag rail 80 which applies friction to the exposed upper surface of the panel 35 along the line contacted by drag rail 80. Simultaneously, glue is applied to the areas 68. The opening up of the slot 76 combined with the slight rearward swinging of the brace panel 35 causes the tab 75 to enter into the open slot 76 thus providing assurance that the cross panel 36 will be precisely centered beneath the top wall 12 when the top panel 51 is finally folded down onto the glued brace panel 35.

This initial slight misalignment with positive means for providing alignment provides assurance that the brace panel will ultimately be properly aligned with the top wall. If it were not for the imparting of the slight misalignment, there is a possibility that the brace panel 35 and end panel 14 could be slightly misaligned upstream of center when they are folded over. If misaligned in that direction, there is no way that friction forces could be applied to return the brace panel in a downstream direction with respect to the top panel as the blank is moving in a downstream direction.

Figure 9:
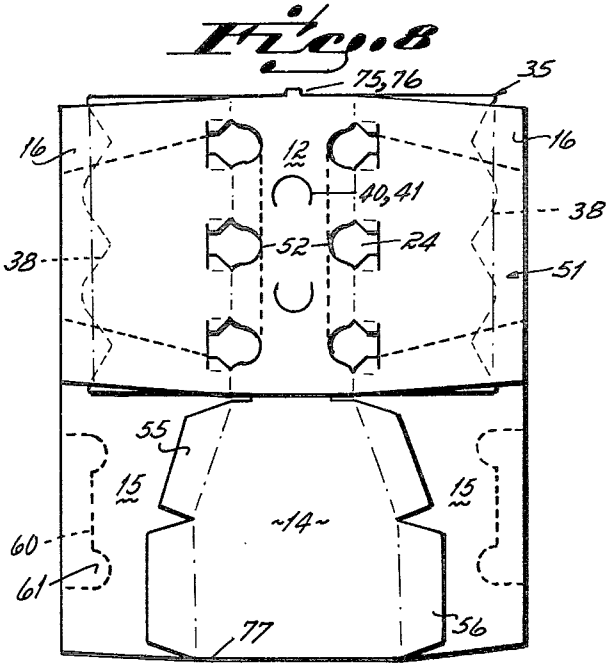

As indicated in FIGS. 8 and 9, a final fold of the top panel 51 along the juncture of the top panel 51 and the end panel 13 is made with the top panel and particularly the top wall 12 being glued to the brace panel 35. The blank in this condition is thereby completed by the converter and is ready to be run by the bottler as the container is filled with bottles.

Figure 3:
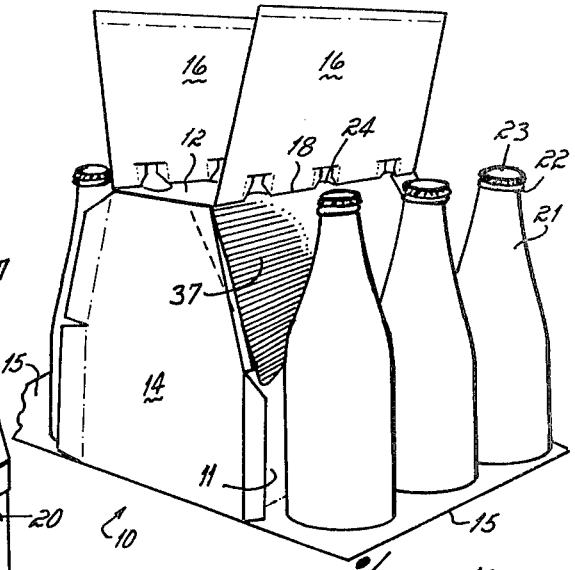
FIGS. 3, 4 and 5 are perspective views showing the manner in which the containers are filled with bottles.
Figure 4:
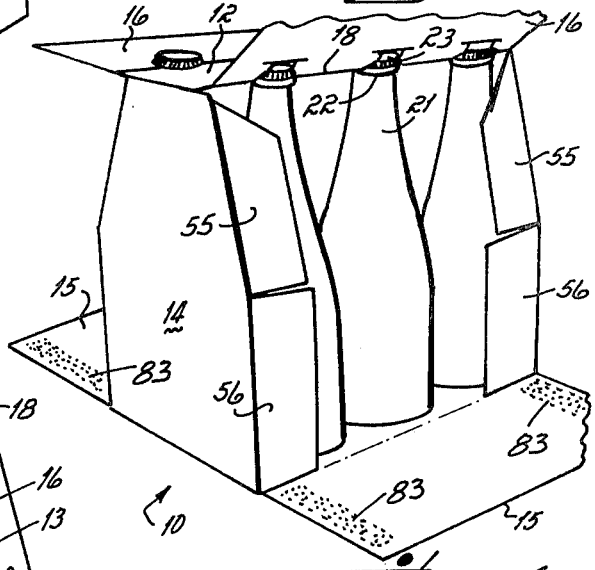
Figure 5:
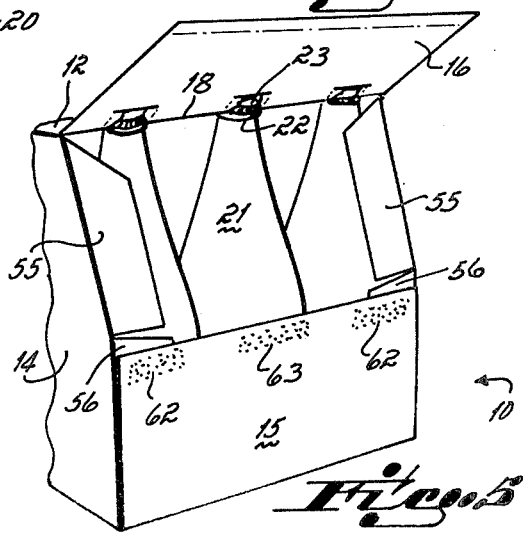

The loading of bottles into the container is performed generally as disclosed in U.S. Pat. No. 3,225,510 and as illustrated in FIGS. 3–5.

The container is first erected into a tubular form with the upper side flaps 16 and depending brace panel flaps 37 lying in a generally horizontal plane. The upper side flaps 16 are swung upwardly as shown in FIG. 3 and the depending panels 37 are plowed down. As shown in FIGS. 3 and 4, three bottles are slid from each side of the container transversely into the tube over the lower flap 15. In sliding into the container, the bottles force the depending brace panels 37 into the center of the container where they form, with the cross panel 36, an inverted channel-shaped beam.

Glue is applied to the areas 83 of the lower side panel 15 and it is plowed up into contact with the glue flaps 56 which have been swung inwardly to overlie the end bottles. The lower flap 15 is then pressed into contact with the glue flaps 56 so as to secure the lower flap to the glue flaps. Glue is then applied to the edge of the lower flap 15 in the areas 62 and 63. The upper flaps 16 are then plowed down with their lower edges making contact with the glue areas 62 and 63 to complete the enclosure of the bottles within the container. The container thus appears as is shown in FIG. 1.

In use, the consumer pushes through tabs 40, 41 in the top wall and grips the container using finger and thumb which he can quite comfortably do because of the double thickness of the combined top wall and brace panel. In this fashion, he carries the container with the full bottles, as shown in FIG. 1, to its place of use. When the contents of the bottles are to be consumed, the user simply lifts up on the lower edge of the access panel 54 and tears it off, thereby exposing three bottles on a side. In this condition, the container can still be carried from place to place with the full bottles within the container, the brace tab providing a double thickness to the top wall and engaging the end panels with the channel-shaped beam configuration providing sufficient rigidity to the container to support that load. After the contents are consumed, the bottles can be returned to the container which has retained the basic shape of a basket-type container, and in this condition the bottles can be returned to collect money on the returnables.

Figure 6:
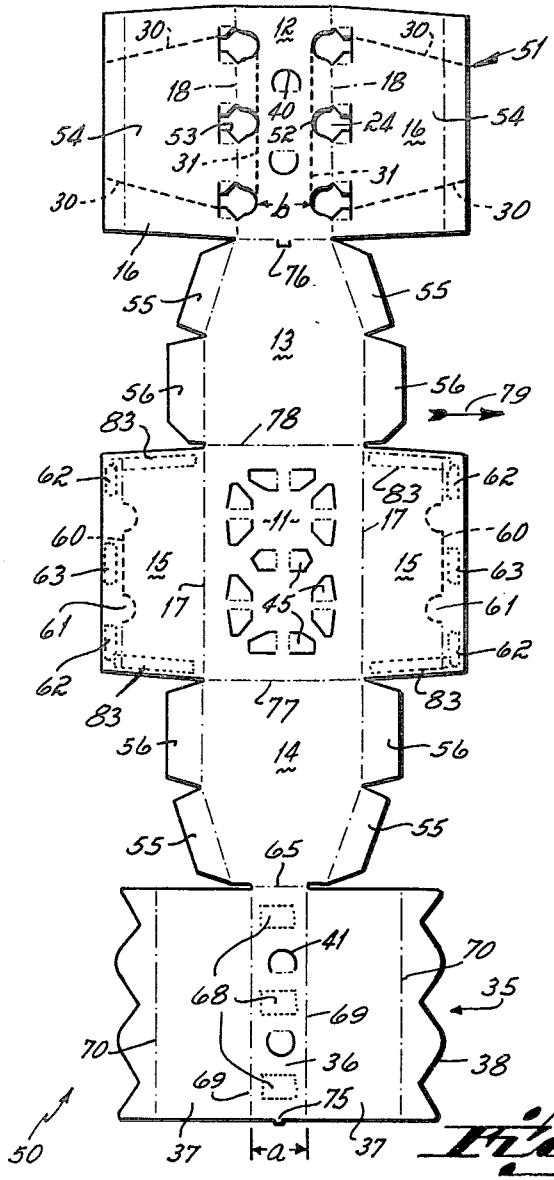
FIG. 6 is a plan view, printed side down, of a blank from which the container is formed.

In the illustrated form of the invention, the brace panel 35 is shown and described as an integral member of the blank illustrated in FIG. 6. It should be understood that the brace panel could be formed as a separate panel which would be applied and glued to the top panel as a separate operation. This form of the invention would admit of the possibility of using a different material than that from which the blank is formed should that be desired.

I claim:

1. A returnable container for glass bottles comprising,
a tube formed by a bottom wall, two end walls and a top wall,
an internal brace comprising a cross panel glued to the underside of said top wall and two depending panels in the center of said tube, said brace extending between said end walls,
and side walls enclosing bottles within said tube,
said side walls having a perforated upper portion creating a removable access panel.

2. A container as in claim 1 further comprising,
a pair of aligned finger holes on said cross panel and top wall, respectively.

3. A container as in claim 1,
said container having bottle neck-receiving apertures at the junctures between said top wall and said side walls,
said brace cross panel being secured to said top wall by glue spots which are aligned with said apertures, thereby minimizing the possibility of inadvertent tailing of glue onto the side walls of the container.

4. A container as in claim 1 in which the lower edges of said depending brace panels are engageable with the sides of bottles which are loaded into said containers,
said lower edges being scalloped to minimize scraping contact with the labels of bottles packaged in said container.

5. A container as in claim 1,
said access panel being defined by generally vertical perforations adjacent the end walls, and a horizontal perforation adjacent the juncture between said top wall and said side walls, said horizontal perforation connecting said vertical perforations,
said access panel, when removed, exposing all bottles between said side wall and a depending brace panel for easy removal.

6. A container as in claim 1 further comprising,
an alignment tab projecting from one edge of said brace cross panel,
a slot at the juncture of said top wall and one of said end walls,
said tab projecting through said slot thereby assuring precise centering of said brace on said top wall.

7. A returnable container for glass bottles comprising,
a tube formed by a bottom wall, two end walls and a top wall, and
an internal brace comprising a cross panel glued to the underside of said top wall and two depending panels in the center of said tube,
said brace extending between said end walls.

8. The method of forming a folded container blank ready for erection and filling with bottles comprising the steps of,
forming a blank having five serially connected panels consisting of
an apertured top panel having upper side flaps hinged thereto,
a first end panel,
a bottom panel having lower side flaps hinged thereto,
a second end panel,
and a brace panel including a cross panel and depending panels hinged thereto, feeding said blank in a horizontal path transverse to the major dimension of said blank, first folding said second end panel and brace panel over upon said bottom and end panels, respectively, applying glue to said cross panel of said brace panel, folding said top panel onto said brace panel.

9. The method as in claim 8 further comprising the steps of forming a tab at the free edge of said cross panel, forming a slot at the juncture of said top and first end panel, said tab projecting into said slot when said top panel is folded onto said brace panel.

10. The method as in claim 9 in which said brace panel is slightly skewed with respect to said top panel when said first fold is made whereby said tab is slightly downstream of said slot.

and applying a drag on said brace panel between said first and second folding steps to bring said tab into alignment with said slot.

11. The method of loading a container formed as a tube having a bottom wall, opposed end walls, top wall, depending side flaps hinged to said top wall and an internal brace consisting of a cross panel glued to the underside of said top wall, and two depending panels generally parallel to said side flaps comprising the steps of, moving said container in a horizontal direction perpendicular to the axis of said tube, holding said side flaps at an inclined angle above horizontal, plowing said depending panels downwardly to an angle of about 45°.

and side-loading bottles into each side of said container wherein the bottles force said depending panels to a substantially vertical position between the bottles on each side of said container.

* * * * *